US009022909B2

(12) United States Patent
Kermath et al.

(10) Patent No.: US 9,022,909 B2
(45) Date of Patent: May 5, 2015

(54) ADAPTIVE SPLIT CARRIAGE EXERCISE REFORMER

(71) Applicant: Reform 180, Inc., Austin, TX (US)

(72) Inventors: Maria Joanna Kermath, Austin, TX (US); Gregg Luconi, Monrovia, CA (US)

(73) Assignee: Reform 180, Inc., Austin, TX (US)

( * ) Notice: Subject to any disclaimer, the term of this patent is extended or adjusted under 35 U.S.C. 154(b) by 82 days.

(21) Appl. No.: 14/046,711

(22) Filed: Oct. 4, 2013

(65) Prior Publication Data

US 2014/0100089 A1 Apr. 10, 2014

Related U.S. Application Data

(60) Provisional application No. 61/709,438, filed on Oct. 4, 2012.

(51) Int. Cl.

| | |
|---|---|
| ***A63B 22/00*** | (2006.01) |
| ***A63B 69/18*** | (2006.01) |
| ***A63B 21/04*** | (2006.01) |
| ***A63B 21/00*** | (2006.01) |
| ***A63B 26/00*** | (2006.01) |
| ***A63B 21/02*** | (2006.01) |
| ***A63B 21/16*** | (2006.01) |
| ***A63B 22/20*** | (2006.01) |

(52) U.S. Cl.

CPC ..... *A63B 21/00018* (2013.01); *A63B 21/023* (2013.01); *A63B 21/143* (2013.01); *A63B 21/1438* (2013.01); *A63B 21/1469* (2013.01); *A63B 21/154* (2013.01); *A63B 21/16* (2013.01); *A63B 22/0089* (2013.01); *A63B 22/203* (2013.01); *A63B 21/0428* (2013.01); *A63B 2022/0038* (2013.01)

(58) Field of Classification Search

CPC ..... A63B 21/00003; A63B 21/00007; A63B 21/00018; A63B 21/00021; A63B 21/00025; A63B 21/00047; A63B 21/023; A63B 21/04; A63B 21/0407; A63B 21/0428; A63B 21/0442; A63B 21/055; A63B 21/0552; A63B 21/1457; A63B 21/1461; A63B 21/1488; A63B 21/151; A63B 21/153; A63B 21/154; A63B 21/156; A63B 22/0061; A63B 21/0087; A63B 21/0089; A63B 21/20; A63B 21/203; A63B 2022/0038

See application file for complete search history.

(56) References Cited

U.S. PATENT DOCUMENTS 1,621,477 A 3/1927 Pilates
3,582,069 A * 6/1971 Flick et al. ..... 482/70

(Continued)

FOREIGN PATENT DOCUMENTS

JP 2001178847 A 7/2001

*Primary Examiner* — Oren Ginsberg
(74) *Attorney, Agent, or Firm* — James A. Sheridan

(57) ABSTRACT

The disclosure provides apparatus and methods of use pertaining to an adaptive, multi-functional exercise device. In one embodiment, the exercise device includes a split carriage formed of separate carriage platforms that may optionally be used in a unified mode, in which the carriage platforms move in unison, or in a split mode, in which the carriages move independently. The device also includes at least one set of ropes that are tied to the carriage platforms such that they translate the resistance of the carriage platforms when manually manipulated. The device further includes split hand and/or foot rests that may be adjusted in multiple directions depending on the demands of the particular exercise in practice. Other embodiments are also disclosed.

10 Claims, 13 Drawing Sheets

(56) References Cited

U.S. PATENT DOCUMENTS

| | | | | |
|---|---|---|---|---|
| 4,679,786 | A * | 7/1987 | Rodgers | 482/70 |
| 4,979,731 | A | 12/1990 | Hermelin | |
| 5,224,909 | A * | 7/1993 | Hamilton | 482/70 |
| 5,653,670 | A | 8/1997 | Endelman | |
| 5,656,003 | A | 8/1997 | Robinson et al. | |
| 5,681,249 | A | 10/1997 | Endelman | |
| 5,989,163 | A | 11/1999 | Rodgers, Jr. | |
| 6,120,425 | A | 9/2000 | Endelman | |
| 6,302,830 | B1 | 10/2001 | Stearns | |
| 6,338,704 | B1 | 1/2002 | Endelman | |
| 6,494,816 | B1 | 12/2002 | Corrado | |
| 6,527,685 | B2 | 3/2003 | Endelman et al. | |
| 6,837,838 | B2 | 1/2005 | List | |
| 6,971,976 | B2 | 12/2005 | Endelman et al. | |
| 7,125,367 | B1 | 10/2006 | Stearns | |
| 7,771,328 | B2 | 8/2010 | Gerschefske | |
| 7,803,095 | B1 | 9/2010 | LaGree | |
| 7,850,584 | B2 | 12/2010 | Uygan | |
| 7,998,043 | B2 | 8/2011 | Zhou et al. | |
| 8,137,250 | B1 | 3/2012 | Caban | |
| 8,157,714 | B2 | 4/2012 | Mayr | |
| 2014/0011645 | A1* | 1/2014 | Johnson et al. | 482/121 |
| 2014/0031175 | A1* | 1/2014 | Peralo | 482/66 |
| 2015/0065320 | A1* | 3/2015 | Anderson | 482/142 |

* cited by examiner

ADAPTIVE SPLIT CARRIAGE EXERCISE REFORMER

REFERENCE TO PENDING PRIOR PATENT APPLICATION

This application claims the benefit under 35 U.S.C. 119(e) of U.S. Provisional Patent Application No. 61/709,438, filed Oct. 4, 2012 by Maria Joanna Kermath and Gregg Luconi for "SPLIT CARRIAGE EXERCISE REFORMER," which patent application is hereby incorporated herein by reference.

BACKGROUND

Pilates is a physical fitness system developed in the early 20th century by Joseph Pilates. The method seeks to develop controlled movement from a strong core. Today tens of thousands of instructors instruct millions of Americans in this popular and effective exercise discipline.

Originally developed as a series of mat exercises, the Pilates method quickly evolved to take advantage of several pieces of equipment. Each piece of equipment is configured for particular exercises, and many utilize springs or other biasing elements to provide resistance training. Resistance may be "progressive resistance," in which resistance increases as the biasing element is stretched or compressed, or "linear resistance," in which the resistance remains constant as the biasing element is manipulated.

The most widely used Pilates apparatus has long been the reformer. Reformers are made in a variety of styles and materials. For example, some reformers are made of wood, while others are formed of metal. Some reformers sit low to the ground, while others are elevated upon pedestals or legs. Despite this variety, reformers existing in the prior art have many commonalities, as shown in FIGS. 1-3, which illustrate a typical example of a reformer 50. Reformer 50 includes a frame 52, a foot/hand bar 54, a unified carriage 56 to support the body of a user, generally in a sitting, lying, or kneeling position, a set of springs (not shown) that may be adjusted to achieve a desired resistance, a headrest 60, shoulder blocks 62 to stabilize the user as the carriage is moved, and a set of straps 64 that tie to carriage 56 through a set of elevated pulleys 66.

Pilates is generally practiced in a studio environment under the direction of a certified instructor. This business model introduces a number of practical, logistical, and financial concerns relating to how Pilates equipment can and should function. For instance, studio-quality Pilates equipment is sturdy equipment that consumes a great deal of space within a studio. Each piece of equipment is an investment, with reformers reaching several-thousand dollars apiece. Under these types of space and economic constraints, it is desirable for each piece of studio equipment to provide a maximum range of exercises, thereby allowing the studio to maximize the range of classes offered, while minimizing its investment in equipment and making the most efficient and economically advantageous use of its studio space.

While existing reformers may be used to complete a variety of exercises, they are often supplemented with several other types of equipment, such as chairs, barrels, towers, and, more recently, the CoreAlign® system. As shown in prior art FIG. 4, a CoreAlign® system 100 utilizes a frame 102 that fully encloses two separate tracks 104 and two separate carts 106. Carts 106 move independently within tracks 104 using resistance created by elastic tubes (not shown) suspended between each cart 106 and one or both ends of the frame 102. Unlike reformers, which, as discussed above in reference to FIGS. 1-3, feature a unified carriage instead of two separate carts, the CoreAlign® system allows for split or scissor-type movement of the legs and/or other body parts. Like reformers, each CoreAlign® system costs thousands of dollars and consumes a substantial real-estate imprint.

To achieve the array of exercise offerings that customers demand and studio owners and instructors desire to provide, many studios invest in both reformer and CoreAlign® equipment, which requires not only a significant capital outlay, but also substantially increases cash flow requirements in the form of ongoing maintenance expenses and expenses to lease or buy sufficient studio square footage. In addition, the need to use two sets of standing, non-portable equipment to achieve a full array of desired exercises reduces a studio's flexibility in terms of class offerings and/or instructor scheduling. To make both types of equipment available during any given class, half of the equipment must be free for a portion of the time. That is, instead of twenty customers taking a class in which they utilize a single piece of equipment, a class maxes out at ten customers who each utilize two pieces of equipment over the duration of the class. Thus, the studio's expenses increase while profits decrease, an objectionable combination.

While the above discussion focuses on the studio environment, it should be noted that some individual practitioners have the resources and do purchase Pilates equipment such as the reformer and/or CoreAlign® system for home use. That said, these consumers have similar concerns to studio operators in that they must purchase and maintain multiple pieces of equipment and have the space available to keep these non-portable devices exercise ready in order to get the complete workout desired.

Equipment manufacturers, unlike studio owners and instructors, are disincentivized to innovate in the arena of multifunctional equipment that can perform the functions of multiple systems because there is a ceiling on what any given apparatus can cost, and fewer machines on offer results in lower sales. The concerns of the individual practitioner or practice provider differ, however, and demand visionary equipment that can fulfill multiple roles.

SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

One embodiment provides an exercise apparatus. The exercise apparatus includes a frame having first and second ends, a primary pulley system disposed between the first and second ends of the frame, a biasing element coupled between the frame and the primary pulley system and configured to apply a resistance to the primary pulley system, a secondary pulley system coupled to the primary pulley system and configured to leverage the resistance applied to the primary pulley system, and a carriage coupled to the secondary pulley system, the carriage having first and second platforms configured to move in unison along an axis of the primary pulley system or in independent directions along an axis of the secondary pulley system.

Another embodiment provides an exercise reformer including a frame having first and second ends, a split carriage coupled to the frame and having first and second platforms configured to slide independently or in unison between the first and second ends of the frame. The exercise reformer also includes a first rope having a tethered end and a free end and a second rope having a tethered end and a free end. The tethered ends of the first and second ropes are tied to the first and second platforms, respectively, and the free ends of the first and second ropes are configured for user manipulation.

Yet another embodiment provides a multi-functional exercise device including a frame having first and second sides that parallel an x-axis, first and second ends that parallel a y-axis, and a continuous edge that parallels a z-axis. The exercise device also includes a split carriage slidably connected to the frame and configured to travel between the first and second ends along the x-axis and at least one split support rest mounted to the first end. The support rest includes a first L-bar pivotally mounted to the first side of the frame and a second L-bar pivotally mounted the second side of the frame, wherein the first and second L-bars each rotate independently about the y-axis and the z-axis.

An additional embodiment provides a method of exercising using an apparatus having a frame with front and rear ends, resistance-loaded left and right carriage platforms slidably connected to said frame and configured to travel independently or in unison between said front and back ends, and left and right ropes. The left rope is tethered to the left carriage platform and coupled to a left force-transmittal loop, and the right rope is tethered to the right carriage platform and coupled to a right force-transmittal loop. The method includes the steps of resting a first body portion upon the left carriage platform and a second body portion upon the right carriage platform and grasping a free end of the left rope and a free end of the right rope. The method also includes first pulling the free end of the left rope in a rearward direction, thereby moving the left carriage platform and the first body portion in a forward direction while moving the right body portion and the right carriage platform in the rearward direction, thereby pulling the free end of the right rope in the forward direction. The method further includes second pulling the free end of the right rope in the rearward direction, thereby moving the right carriage platform and the second body portion in the forward direction while moving the left body portion and the left carriage platform in the rearward direction, thereby pulling the free end of the left rope in the forward direction.

Another embodiment provides a method of exercising using an apparatus having a frame with front and rear ends and a split carriage slidably connected to the frame for sliding between the front and rear ends. The split carriage includes at least two independently moving carriages, each attached to an opposite side of a secondary pulley system, which, in turn, is positioned on one side of a primary pulley system that is affixed to the frame. The method includes the steps of positioning different portions of a user's body upon the independently moving carriages and moving the body portions, and therefore, the independently moving carriages in opposing directions between the front and rear ends of the frame.

A further embodiment provides a method of exercising on a reformer having a frame and at least one split support rest. The frame includes left and right sides that parallel an x-axis, front and rear ends that parallel a y-axis, and a continuous edge that parallels a z-axis. The split support rest includes left and right L-bars pivotally coupled to the frame. The method includes the steps of lifting a latch release to free the left and right L-bars to rotate about the y-axis, adjusting the left L-bar to a first desired position about the y-axis, adjusting the right L-bar to a second desired position about the y-axis, and lowering the latch release such that the left and right L-bars lock into the first and second desired positions, respectively.

Other embodiments are also disclosed, and additional objects, advantages and novel features of the technology will be set forth in part in the following description, and in part will become more apparent to those skilled in the art upon examination of the following, or may be learned from practice of the technology.

BRIEF DESCRIPTION OF THE DRAWINGS

Non-limiting and non-exhaustive embodiments of the present invention, including the preferred embodiment, are described with reference to the following figures, wherein like reference numerals refer to like parts throughout the various views unless otherwise specified. Illustrative embodiments of the invention are illustrated in the drawings, in which.

DETAILED DESCRIPTION

Embodiments are described more fully below in sufficient detail to enable those skilled in the art to practice the system and method. However, embodiments may be implemented in many different forms and should not be construed as being limited to the embodiments set forth herein. The following detailed description is, therefore, not to be taken in a limiting sense.

Figure 1:
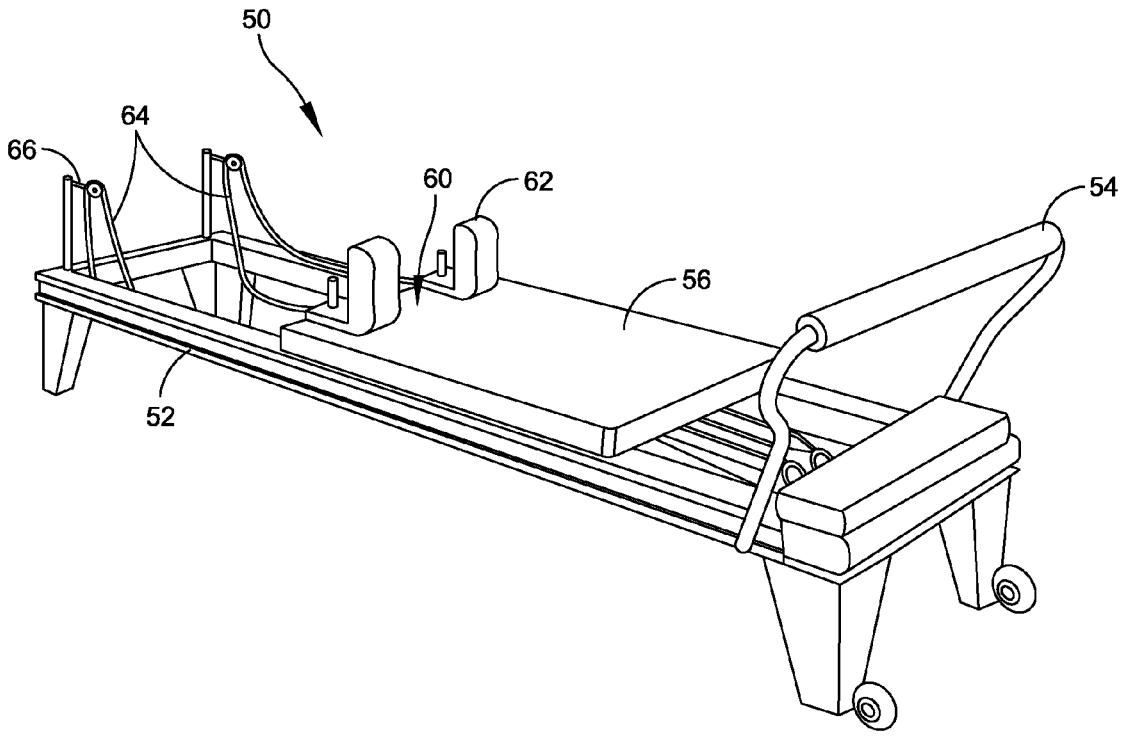
FIG. 1 (PRIOR ART)
FIG. 1 illustrates a perspective view of a prior art reformer device.
Figure 2:
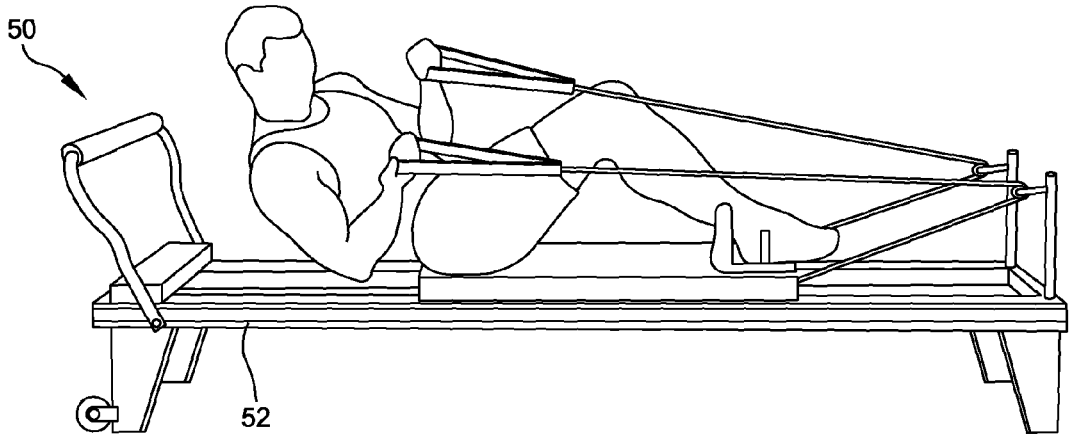
FIG. 2 (PRIOR ART)
FIG. 2 illustrates the prior art reformer device of FIG. 1 subject to a first manner of use.
Figure 3:
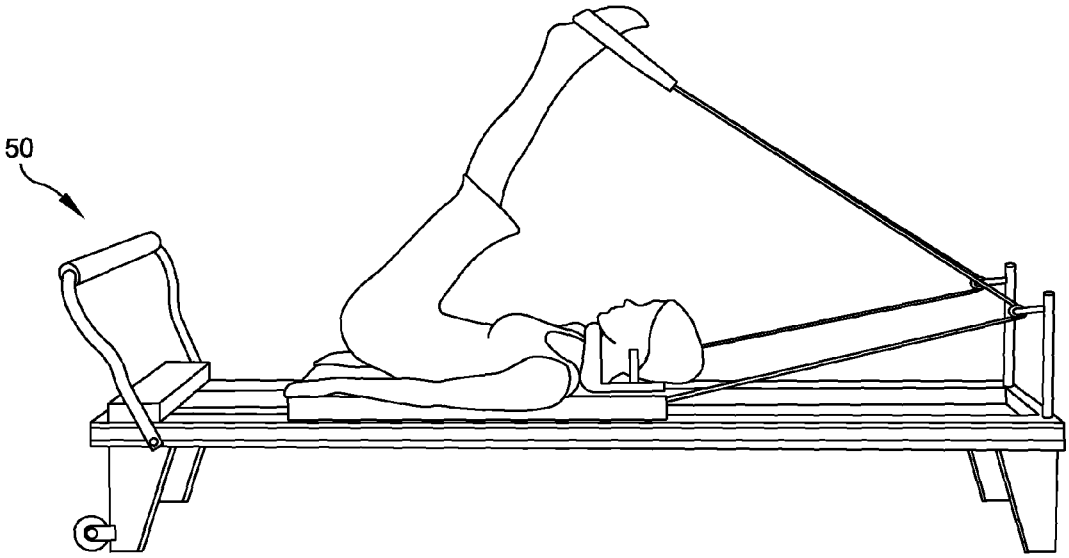
FIG. 3 (PRIOR ART)
FIG. 3 illustrates the prior art reformer device of FIG. 1 subject to a second manner of use.
Figure 4:
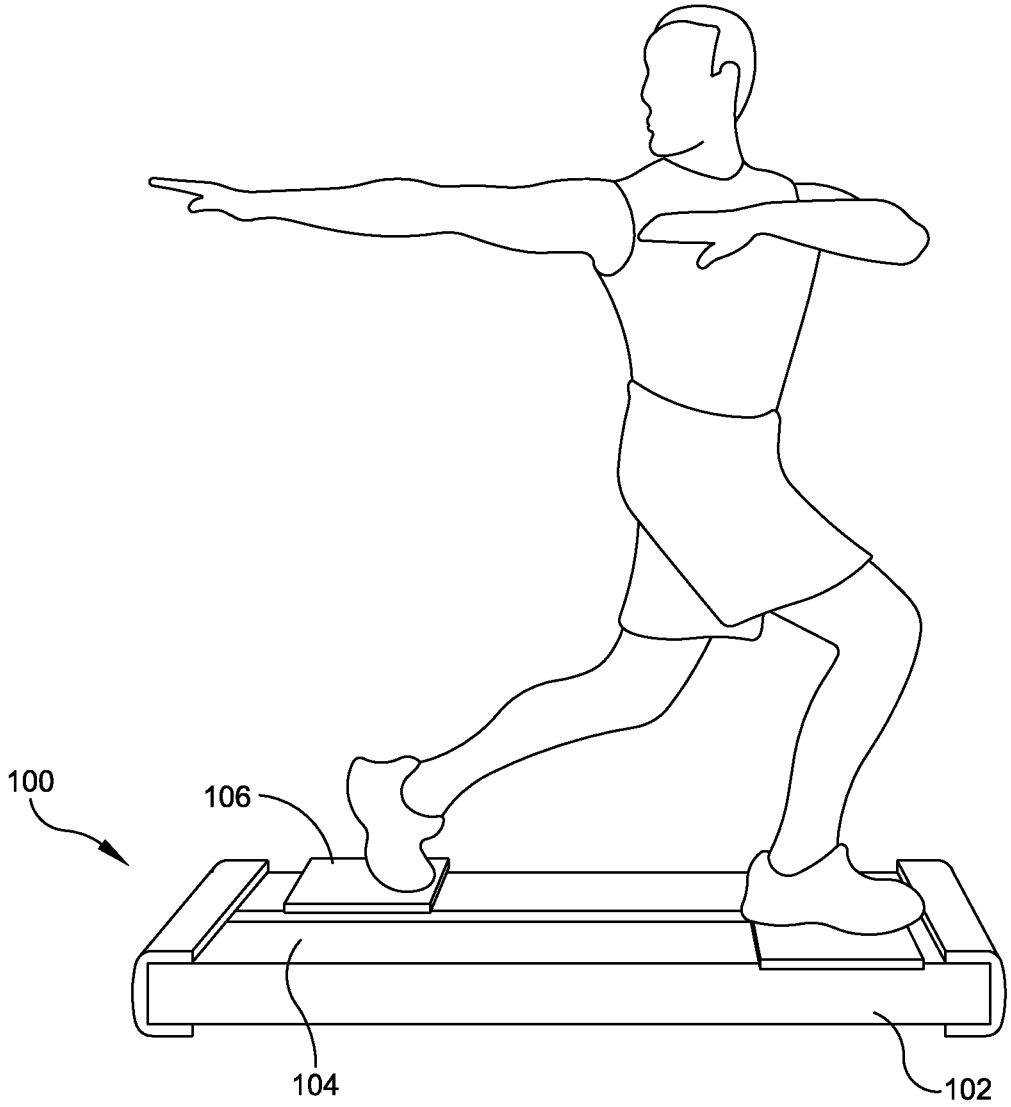
FIG. 4 (PRIOR ART)
FIG. 4 illustrates a perspective view a prior art dual-track exercise device in use.
Figure 5:
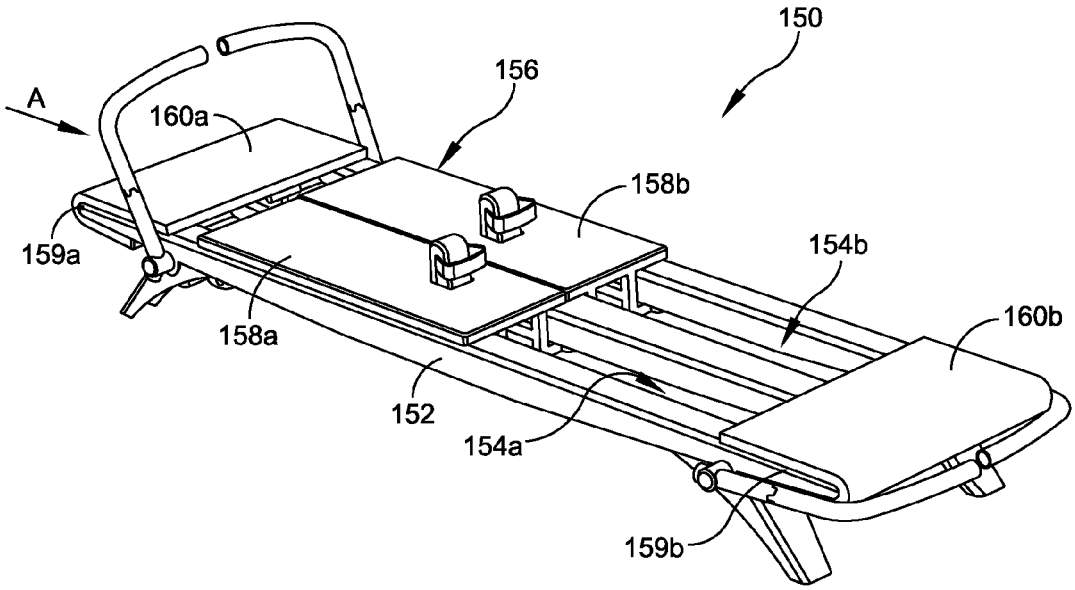
FIG. 5 illustrates a perspective view of an adaptive split-carriage reformer in unified mode.
Figure 6:
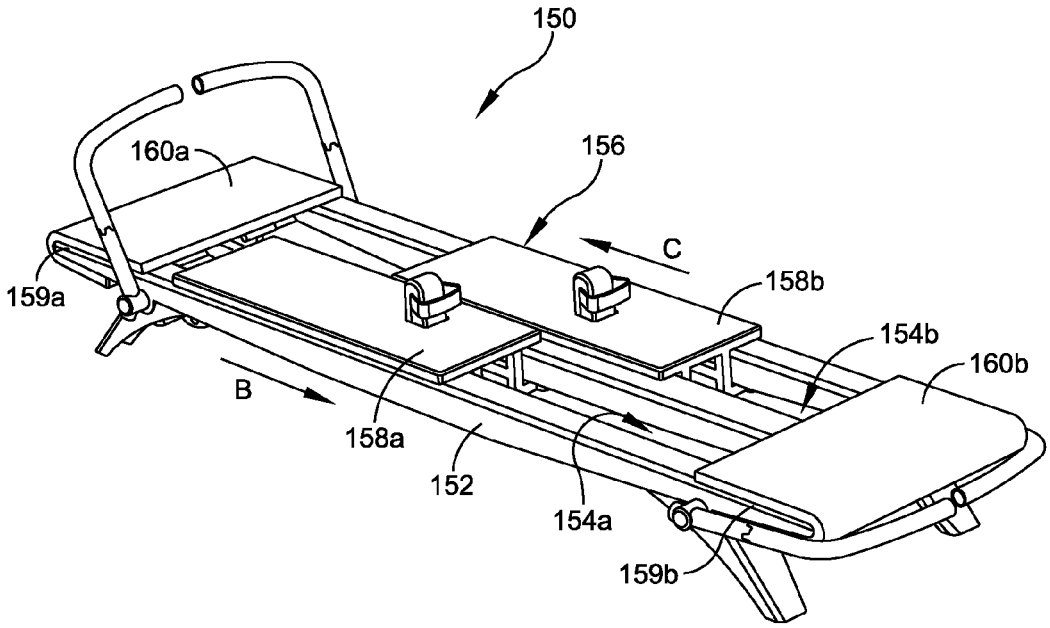
FIG. 6 illustrates a perspective view of an adaptive split-carriage reformer in split mode.

FIGS. 5-6 illustrate perspective views of one embodiment of an adaptive split-carriage reformer 150 operating in unified and split modes, respectively. In this embodiment, reformer 150 may include a frame 152 having dual tracks 154*a*, 154*b* within which a carriage 156 is slidably mounted. Rest platforms 159*a*, 159*b* may border each end of frame 152, and protective pads 160*a*, 160*b* may overlay each rest platform 159*a*, 159*b* for user comfort.

Frame 152 may be formed of any appropriate material or combination of materials (e.g., metal or wood) and may adopt any appropriate size, shape, and/or configuration. While reformer 150 and frame 152 are shown as substantially symmetrical, other embodiments may differ from end to end as appropriate.

Notably, unified carriage 156 may be split into two independent carriage platforms 158*a*, 158*b* that electively move through tracks 154*a*, 154*b* in a same direction depicted by arrow A, shown in FIG. 5, or in opposing directions depicted by arrows B and C, shown in FIG. 6.

Figure 7:
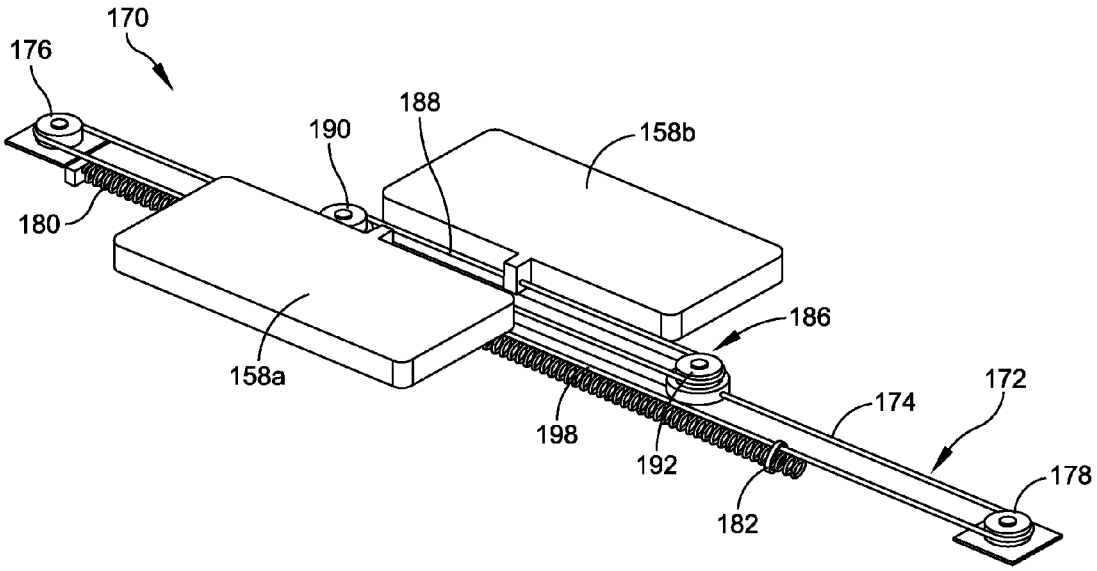
FIG. 7 illustrates a perspective view of a pulley assembly for the adaptive split-carriage reformer of FIGS. 5-6.
Figure 8:
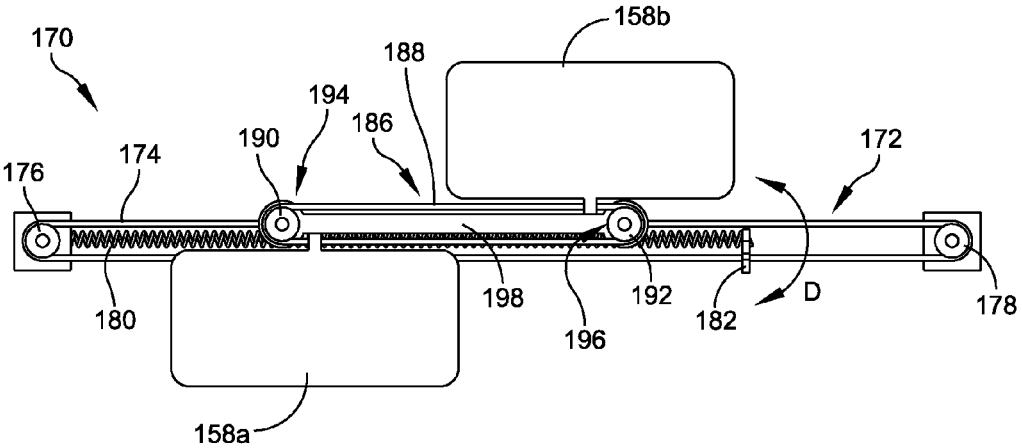
FIG. 8 illustrates a top plan view of the pulley assembly of FIG. 7.

The dual unified and split-mode options for use, described above, are made possible by an embodiment of a pulley assembly 170 shown in FIGS. 7-12. FIGS. 7-8 illustrate perspective and top plan views of one embodiment of pulley assembly 170. In this embodiment, pulley assembly 170 may incorporate two interconnected and interdependent pulley systems. Specifically, a primary pulley system 172 may attach to frame 152 (FIGS. 5-6), directly beneath and in mechanical communication with tracks 154*a*, 154*b* of frame 152 (FIGS. 5-6). An embodiment of primary pulley system 172 may include a primary cable 174 disposed about a first pulley 176 and a second pulley 178. To tension or apply resistance to motion within primary cable 174, a biasing element such as a tension spring 180 may stretch between frame 152 (FIGS. 5-6) near first pulley 176 and a desired location on primary cable 174. A clamp 182 or any other appropriate securing fastener such as a tie or hook may be applied to affix spring 180 to primary cable 174, noting that the position of spring 180 along primary cable 174 defines an amount of resistance placed on primary pulley system 172 and, in turn, the amount of resistance a user must work against when operating reformer 150. In one embodiment, clamp 182 may be configured to toggle between different sides of primary cable 174, shown by arrow D of FIG. 8, so as to change the direction of resistance force applied to platforms 158*a*, 158*b*.

Figure 9:
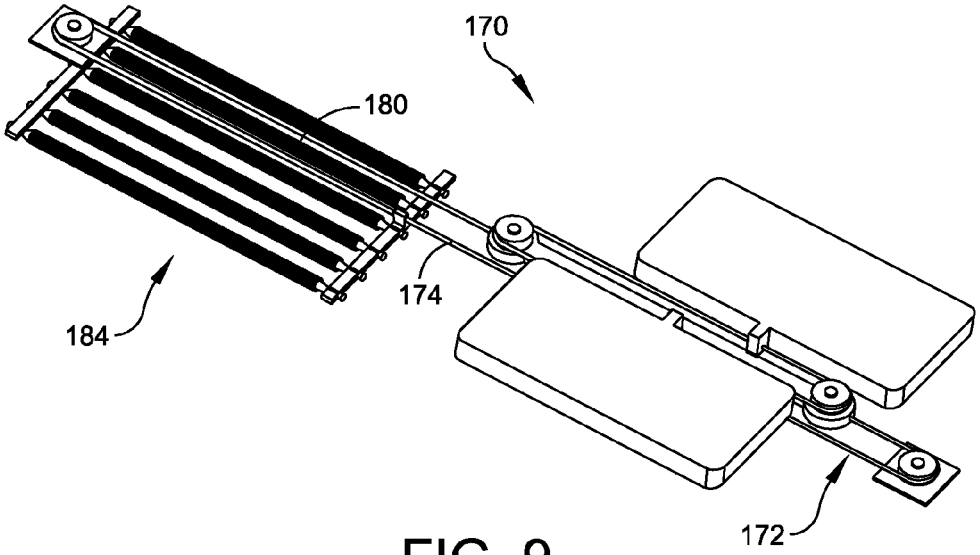
FIG. 9 illustrates a perspective view of the pulley assembly of FIG. 7 modified with a spring system.

In some circumstances, it may be desirable to associate a number of connected springs with primary pulley system 172. FIG. 9 illustrates one embodiment of a spring system 184, rather than a single spring 180, tied to primary cable 174. Spring system 184 may include any appropriate number of associated springs 180 tied together in a manner that allows them to place a collective tension on primary cable 174. Similar to the single-spring embodiment, discussed above, spring system 184 may be adjusted and affixed along primary cable 174 using any appropriate clamping or fastening means.

The above discussion refers to tension or extension springs designed to operate with a tension load under which springs 180 stretch as force is applied. Other embodiments may employ compression springs designed to operate under a compression load, as well as any other appropriate biasing elements suited to the particular physical layout of the reformer embodiment.

While primary pulley system 172 provides for smooth, tensioned movement of united carriage 156 in a single direction (FIG. 5), a more complex system of pulleys allows for an additional option, or for independent movement of carriage platforms 158*a*, 158*b* (FIG. 6) in opposite directions. In this regard, FIGS. 7-8 illustrate an embodiment of a secondary pulley system 186 that may connect to and leverage resistance from primary pulley system 172.

In this embodiment, secondary pulley system 186 may include a secondary cable 188 disposed about a third pulley 190 and a fourth pulley 192. Third pulley 190 and fourth pulley 192 may be affixed at first and second ends 194,196 of a translating bar 198, which may splice primary cable 174 of primary pulley system 172, thereby operatively connecting secondary pulley system 186 to primary pulley system 172.

Figure 10:
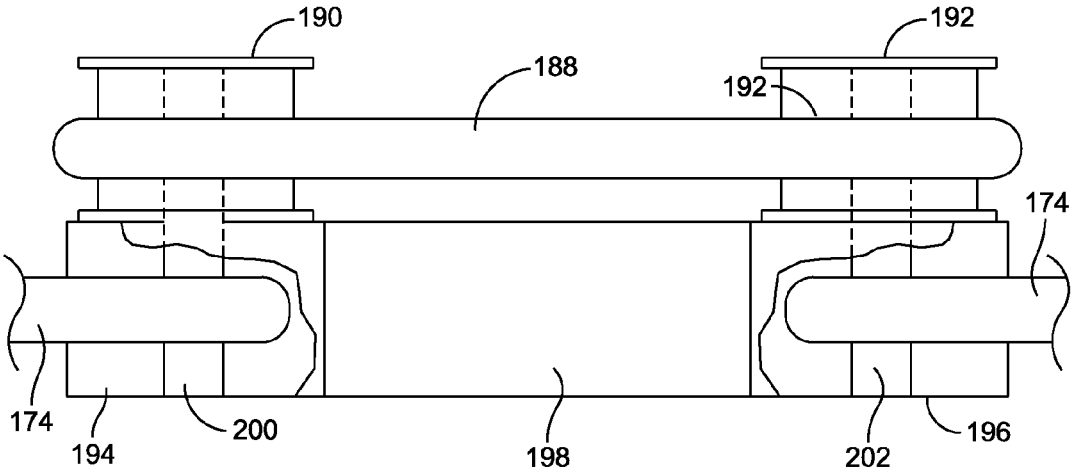
FIG. 10 illustrates a side cut-away view of a portion of the pulley assembly of FIG. 7.

In greater detail, FIG. 10 shows a side plan view of one embodiment of translating bar 198 as coupled to third and fourth pulleys 190, 192 and to primary cable 174. Cut-aways in translating bar 198 illustrate the internal workings of translating bar 198, showing that first and second ends 194, 196 of translating bar 198 may contain first and second spools 200, 202, respectively. Each spool 200, 202 may mechanically communicate with the secondary pulley 190, 192 directly above it, such that the rotation of third pulley 190 in either direction causes an equal rotation in spool 200, while the rotation of fourth pulley 192 in either direction causes an equal rotation in spool 202.

Figure 11A:
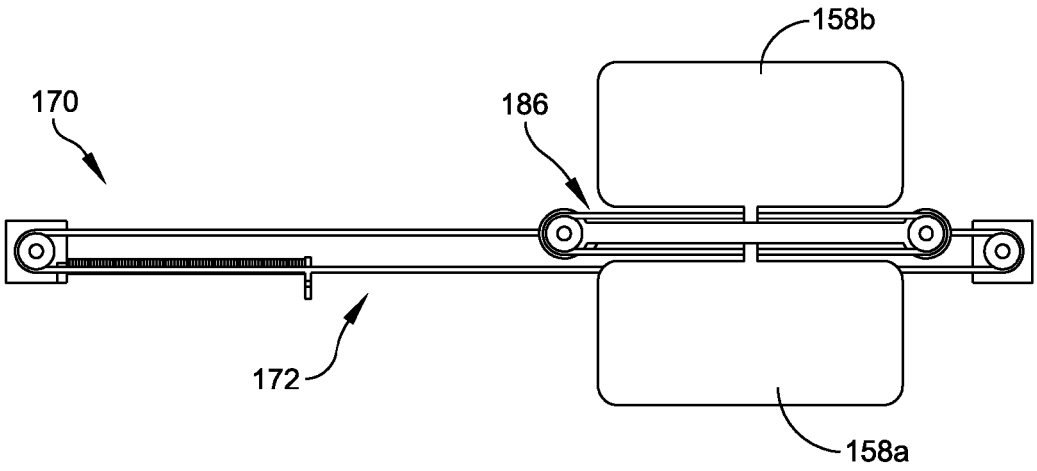
FIGS. 11A-B illustrate top plan views of the pulley assembly of FIG. 7 in unified and split modes, respectively.
Figure 11B:
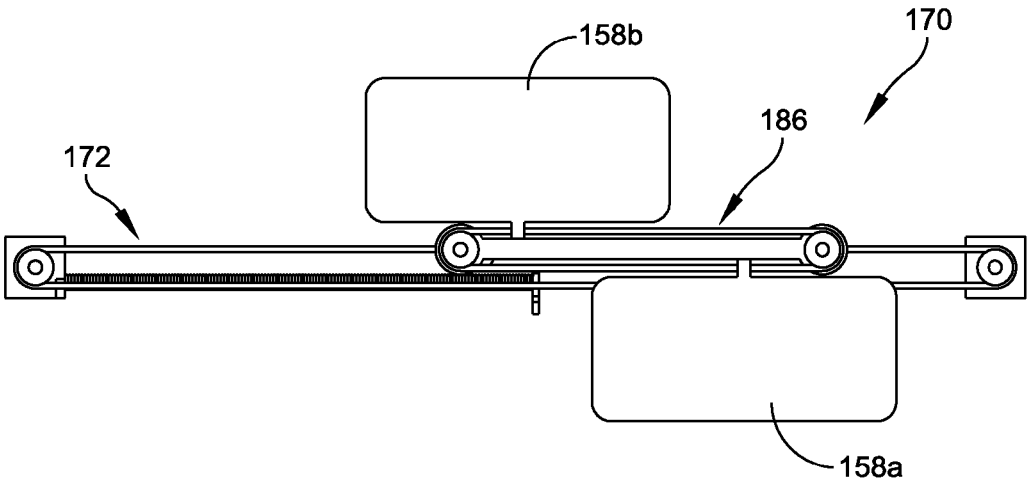

Returning to FIGS. 7-8, carriage platforms 158*a*, 158*b* may be affixed to opposite sides of secondary cable 188. In this configuration, movement of carriage platforms 158*a*, 158*b* in opposing directions rotates third and fourth pulleys 190, 192, which, in turn, rotates spools 200, 202 of translating bar 198, as discussed above. This rotation of spools 200, 202 causes primary cable 174 to be wound into and released from the ends 194, 196 of translating bar 198 as appropriate according to the direction of movement of each carriage platform 158*a*, 158*b*. Thus, when carriage platforms 158*a*, 158*b* are moved in opposing directions, secondary pulley system 186 remains in a fixed position relative to primary pulley system 172 while leveraging the spring or other biased resistance placed upon primary cable 174 of primary pulley system 172. In the split mode, secondary pulley system 186 may be adjusted to any position along primary pulley cable 174 to accommodate a variety of exercises, as shown in FIGS. 11A-B.

Figure 12A:
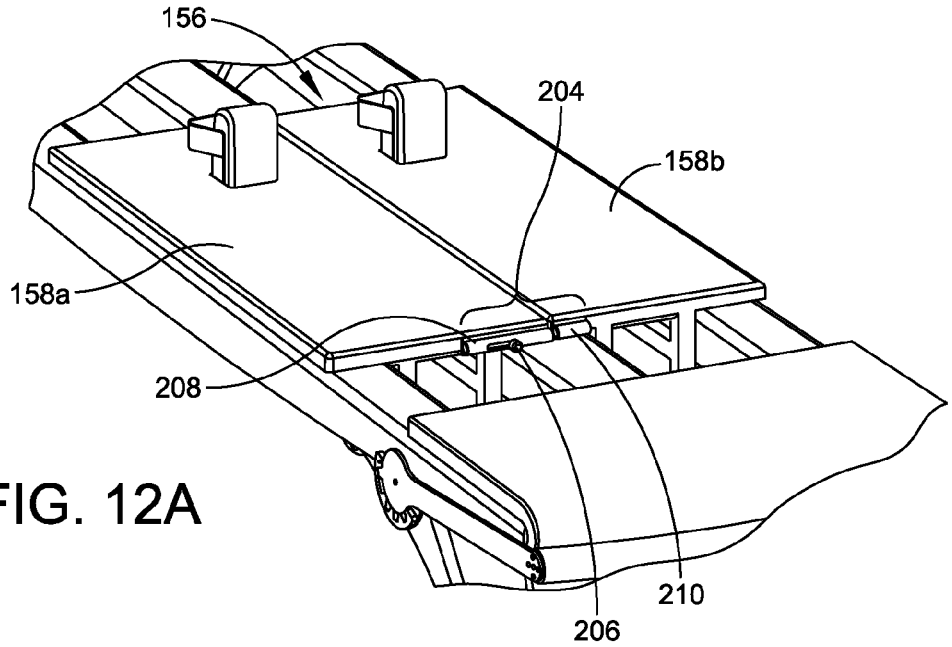
FIGS. 12A-C illustrate perspective views of a carriage latch for locking the reformer of FIGS. 5-6 in unified mode.
Figure 12B:
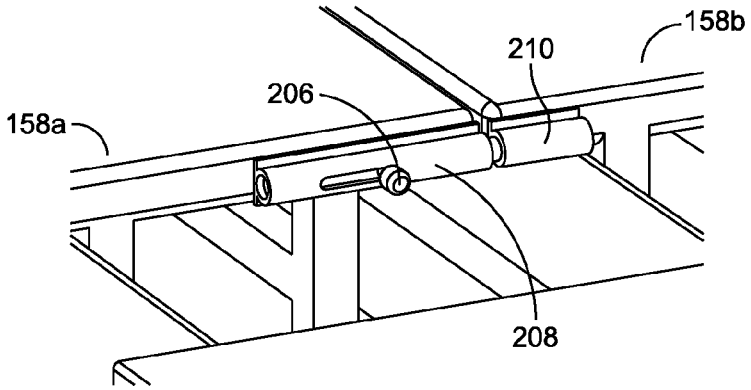
Figure 12C:
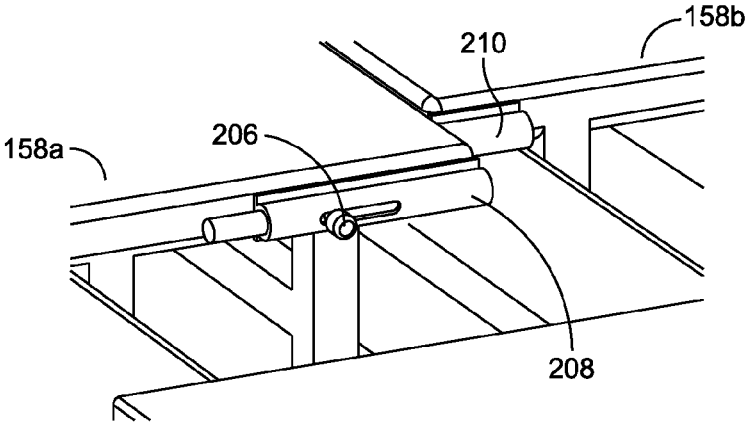

FIGS. 12A-C illustrate one embodiment of a latch 204 for securing independent carriage platforms 158*a*, 158*b* together to form unified carriage 156. In this embodiment, latch 204 may include a slider 206 configured to span a notched housing 208 affixed to platform 158*a* and a receiver housing 210 affixed to carriage platform 158*b*. Manually transitioning slider 206 into and out of receiver housing 210 moves latch 204 between a closed position shown in FIG. 12B, in which platforms 158*a*, 158*b* are unified and move together, and an open position shown in FIG. 12C, in which platforms 158*a*, 158*b* operate independently.

While FIGS. 12A-C show one approach for locking platforms 158*a*, 158*b* to form unified carriage 156, any appropriate locking mechanism may be employed. Alternate embodiments include, but are not limited to, magnetic locking systems, sliding-pin locking systems, or a system formed by semi-circular or half-moon tabs disposed at each end of platforms 158*a*, 158*b* and configured to rotate into and out of alignment by ninety degrees, thereby freeing platforms 158*a*, 158*b* when the half-moons are aligned and locking them when they are rotated.

Using the embodiment of pulley assembly 170 described above, a user may elect to utilize unified carriage 156 to traverse the distance between first and second pulleys 176, 178 on primary pulley system 172 or to utilize carriage platforms 158*a*, 158*b* to traverse the distance between third and fourth pulleys 190, 192 in independent, opposing directions. Substantially equal tension provided by spring 180 or spring system 184 upon primary cable 174 resists a user's movement in either configuration.

The ability to use embodiments of reformer 150 in both unified and split modes allows for a wide variety of exercises that are not available with isolated use of traditional reformers or of traditional split-track equipment such as the Core- Align® system, discussed in the Background above. Maximizing the number and variety of exercises that may be completed on any given machine allows individual users to optimize their experiences without purchasing numerous pieces of bulky, expensive equipment. It also allows exercise studio owners and operators to organize studio equipment in a manner that optimizes the use of expensive studio space and available time-slots for class offerings, thereby reducing capital expenditures, maximizing class offerings, minimizing the amount of time any given machine sits idle, and avoiding redundancies where two otherwise different pieces of equipment might overlap.

Adapting existing equipment to fulfill additional roles has subtle consequences. For example, while the CoreAlign® system, discussed above, is primarily designed for split-track use, the carriages may be situated such that both carriages slide side-by-side within the same track in a single-track mode that leaves the other tack empty. In this configuration, a user may achieve certain exercise positions that are commonly associated with a unified-carriage reformer, such as, for example, the "plank" pose in which a user balances in a push-up position on his or her hands or forearms. While a user may achieve the plank pose on a CoreAlign® system in "single-track" mode, the user must turn perpendicular to the machine to do so. This requires the system to be placed upon a significant footprint of empty space that is large enough for the full length of the user's body to extend sideways from or perpendicular to the machine. Any multiple-function benefit of using the machine in this manner is consumed by the fact that multiple machines cannot be efficiently placed in a way that optimizes the space available.

Figure 13:
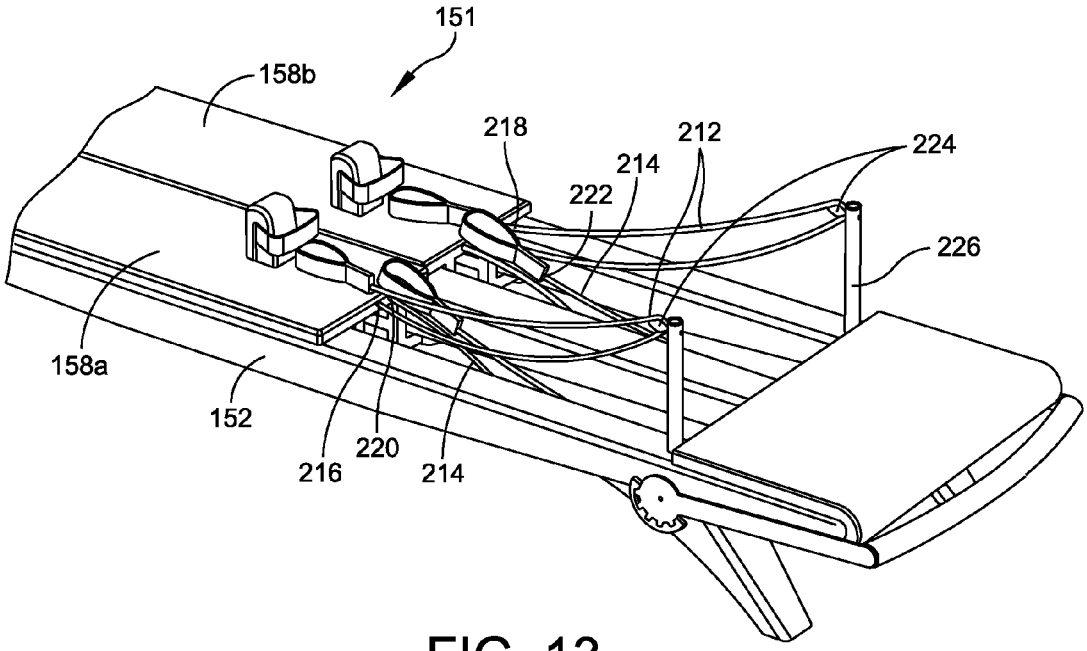
FIG. 13 illustrates a perspective view of an adaptive split-carriage reformer including top and bottom sets of ropes.
Figure 14:
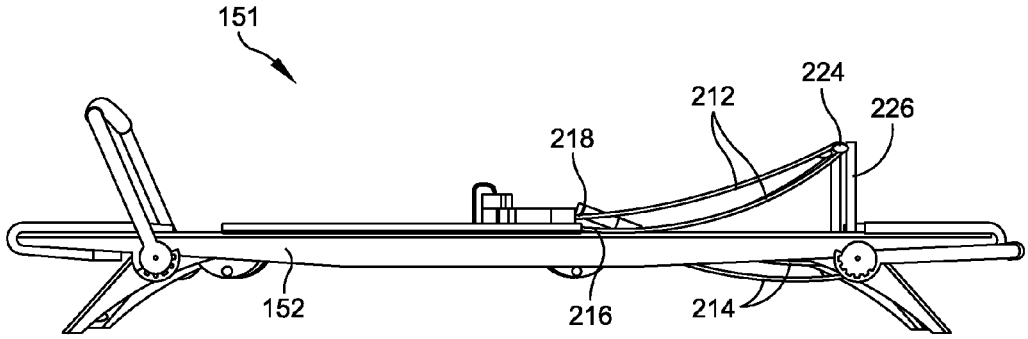
FIG. 14 illustrates a side view of the reformer of FIG. 13.
Figure 15A:
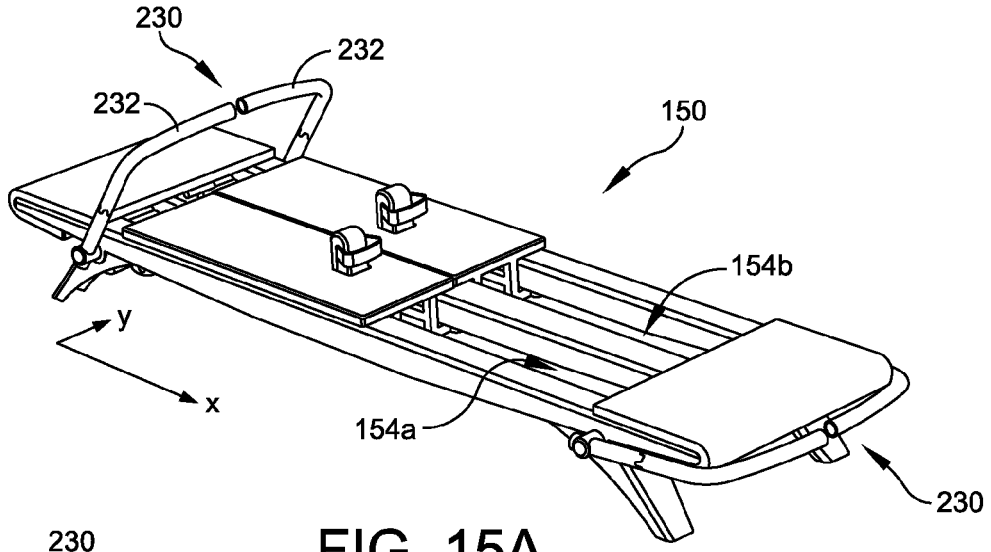
FIGS. 15A-D illustrate a series of perspective views of the reformer of FIGS. 5-6 with a split rest support adjusted to multiple positions about a y-axis.
Figure 15B:
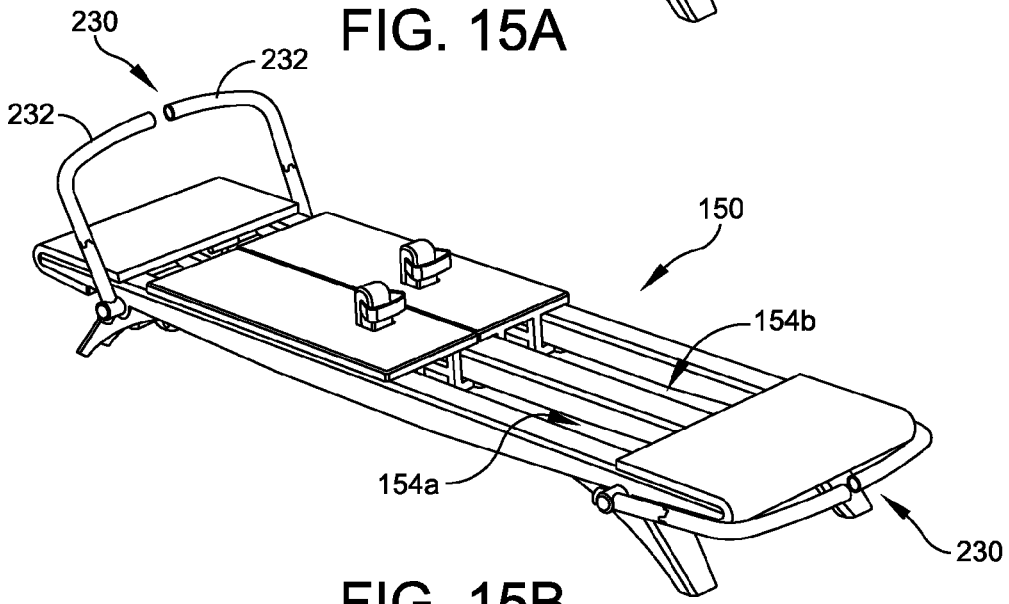
Figure 15C:
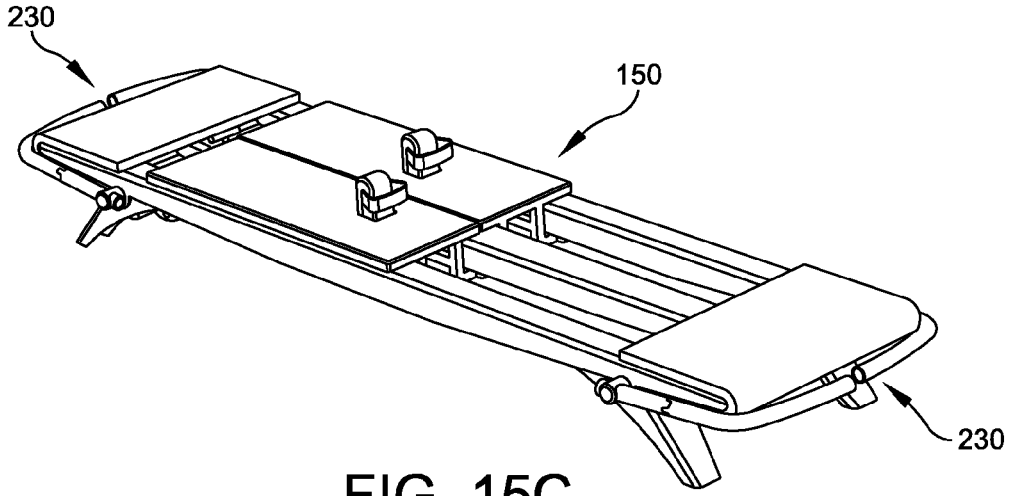
Figure 15D:
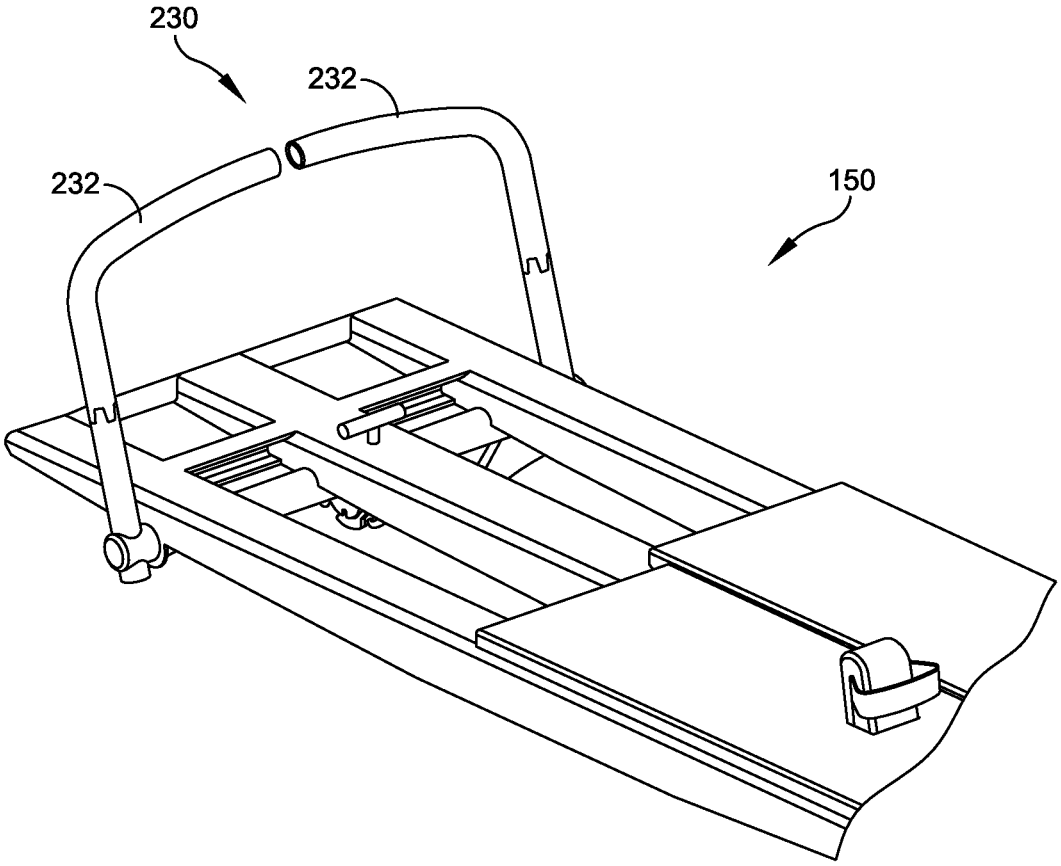

Beyond the unified and split-carriage modes discussed above, another embodiment of an adaptable split-carriage reformer 151 may include one or more sets of ropes for manual manipulation by a user's hands, forearms, feet, ankles, calves or any other appropriate body part, as shown in FIGS. 13-14. Otherwise identical to reformer 150, discussed above, reformer 151 may include a top pair of ropes 212 and a bottom pair of ropes 214. Each of top ropes 212 may have a tethered end 216 and a free end 218. Similarly, each of bottom ropes 214 may have a tethered end 220 and a free end 222.

Turning to top ropes 212, tethered ends of top ropes 216 may be tied to individual carriage platforms 158*a*, 158*b* in any appropriate manner before being threaded through elevated force-transmittal loops 224. Force-transmittal loops 224 may be elevated above frame 152 by riser bars 226 of any appropriate size, shape, type, and/or configuration. Force-transmittal loops 224 may be formed from a simple loop or ring or they me be a more sophisticated pulley. By threading free ends 218 of top ropes 212 through force-transmittal loops 224, the force applied to free ends 218 translates to tethered ends 216 at carriage platforms 158*a*, 158*b*. Thus, the force required to displace top ropes 212, and thus pull one or both carriage platforms 158*a*, 158*b* away from their resting positions, is tied to and dependent upon the force required to directly displace carriage platforms 158*a*, 158*b*. Free ends 218 of top ropes 212 may be adapted for a variety of holds and uses by selectively attaching any appropriate hand/foot cuffs, straps, ropes, and/or other adaptors available to customize the user interface.

Bottom ropes 214 may be similarly tethered to carriage platforms 158*a*, 158*b* in any appropriate manner. Bottom ropes 214 may differ from top ropes 212 in that they may be threaded through sunken, rather than elevated, force-transmittal loops (not shown), either located at an opposite end of riser bars 226 or otherwise attached to the underside of frame 152. While top ropes 212 are ergonomically and structurally fit for use while the user is on or adjacent to carriages 158*a*, 158*b*, bottom ropes 214 are additionally fit for use while the user is on or adjacent to one of rest platforms 159*a*, 159*b* (FIG. 5) of frame 152. In both configurations, ropes 212, 214 may be formed of any appropriate natural or synthetic material such as, for example, rubber, nylon, cotton, polypropylene, polyester, and more.

Existing track-and-rope exercise devices such as the popular NordicTrack® system differ from the described embodiment of reformer 151 in that those devices do not tie or tether manual ropes or pulls to the carriage platforms. Tying ropes 212, 214 to platform carriages 158*a*, 158*b* not only allows for a more elegant and easily manufactured mechanical design that employs one biasing system (e.g., spring 180 or spring system 184) to tension both the carriages 158*a*, 158*b* and the ropes 212, 214, it also provides a useful diagnostic tool. More specifically, when a user utilizes reformer 151 in the split-carriage mode with either top ropes 212 or bottom ropes 214, slight differences in strength or preferences favoring one side of the body over the other become obvious. For example, if a user kneels with one knee on platform 158*a* and the other on platform 158*b* and performs a bicep curl while clasping top ropes 212, any disparate force applied to ropes 212 is reflected in an unequal displacement of carriage platforms 158*a*, 158*b*. If the user favors one arm and pulls harder with the favored arm, the carriage corresponding to the favored limb will displace farther than the other, alerting the user and/or an instructor to the issue. This type of diagnostic may apply to any exercise utilizing the ropes with reformer 151 in split-carriage mode, regardless of the body part working in connection with ropes 212, 214.

FIGS. 15A-D illustrate multiple views of one embodiment of a split support rest 230 that adds further functionality to reformer 150, 151. An identical split support rest 230 may be positioned at each end of tracks 154*a*, 154*b* so as to support a user's hands or feet during exercise. In this embodiment, split support rest 230 includes two identical L-bars 232. Each L-bar 232 may pivot independently about a y-axis, shown in FIG. 15A, to lock at varying angles between upright and stowed positions, as shown in FIGS. 15A-D.

Figure 16:
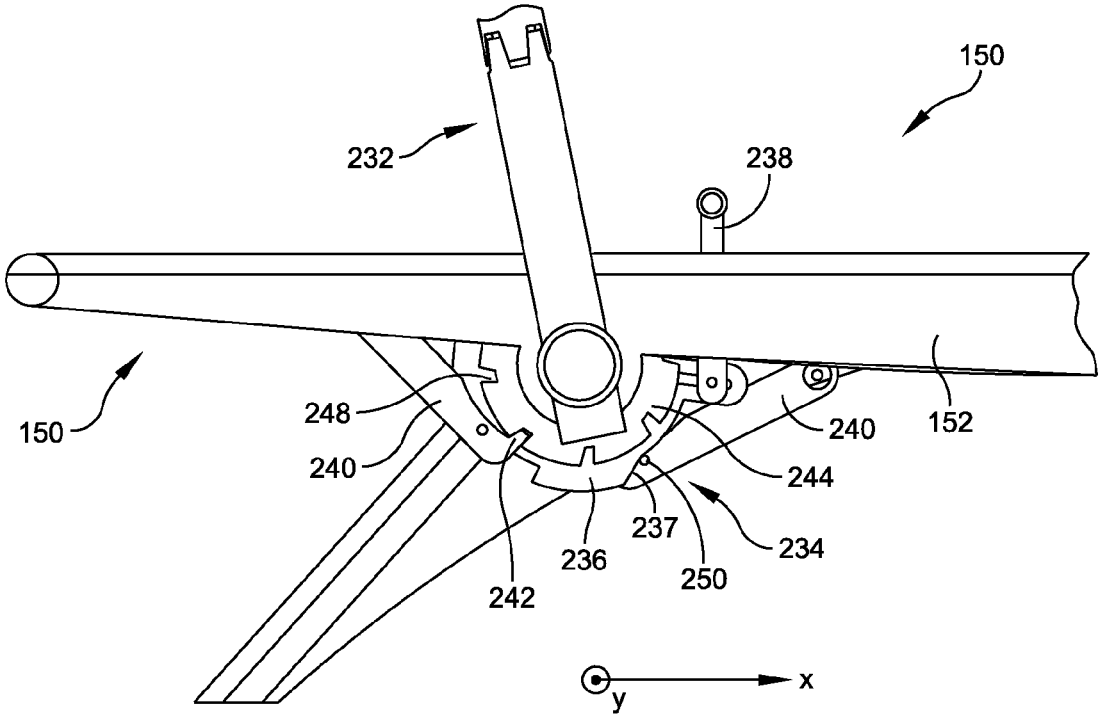
FIG. 16 illustrates a side view of a central transmission system for the split rest support of FIGS. 15A-D.
Figure 17:
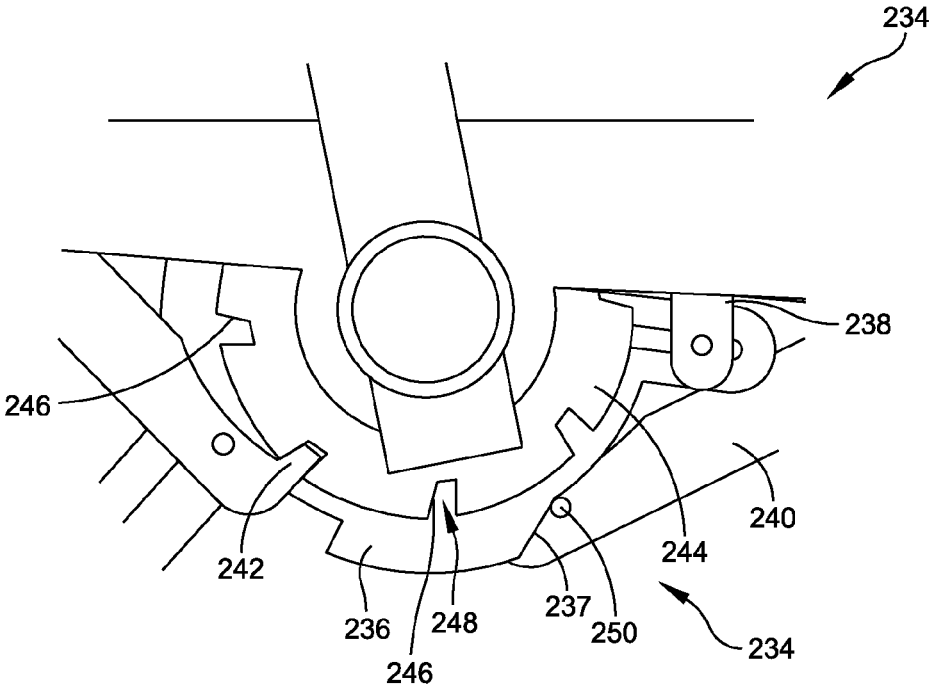
FIG. 17 illustrates another side view of the central transmission system of FIG. 16.

FIGS. 16-17 illustrate one embodiment of a central transmission system 234 for controlling the locking rotation of L-bars 232 about the y-axis. Central transmission system 234 may include a transmission plate 236 disposed beneath frame 152 and between L-bars 232. Transmission plate 236 may operatively connect to a pull lever 238 that extends upward through frame 152 in a user-accessible manner. Transmission plate 236 may also have two defined release edges 237, detailed below, each configured to interact with one L-bar 232.

On either side of transmission plate 236, the workings of central transmission system 234 may be mirror images of each other. On each side, a notched disk 244 may be affixed to L-bar 232 and disposed in center alignment with transmission plate 236 and L-bar 232. A pawl 240 may be rotationally coupled to frame 152 and situated such that a tooth 242 of pawl 240 is sprung tightly into a notch 248 of notched disk 244. A trailing edge 246 of each notch 248 may be tapered to facilitate smooth mating with tooth 242 of pawl 240.

Pawl 240 may be fitted with a perpendicular pin 250 configured to ride or interfere with release edge 237 of transmission plate 236. When pull lever 238 is lifted linearly such that transmission plate 236 rotates about the y-axis intersecting the centerline of L-bar 232, notched disk 244, and transmission plate 236, pin 250 traverses release edge 237 of transmission plate 236, thereby lifting and releasing tooth 242 from notch 248 of notched disk 244. Releasing disk 244 in this manner frees L-bar 232 to rotate to a new angle at which pull lever 238 may be linearly pressed downward, causing transmission plate 236 to rotate back to its original position in which tooth 242 of pawl 240 reengages with another notch 248 of disk 244.

As discussed above, the pawl-disk arrangement located on each side of transmission plate 236 may be configured as a mirror image. As a result, spring-loaded pawls 240 as well as the tapered trailing edges 246 of notches 248 on notched disks 244 may oppose each other. This opposing-notch configuration allows for zero-to-minimum tolerance adjustment of L-bars 232 when opposing spring-loaded pawls 240 engage with notches 248.

The ability to adjust split support rest 230 and each individual L-bar 232 about the y-axis allows the user to incorporate additional exercises into his or her routine. For example, some exercises require a foot rest while others do not. Still other exercises require the feet or hands to rest at different heights. With split support rest 230, a user and/or instructor may employ reformer 150, 151 to easily accommodate these varying demands.

Figure 18A:
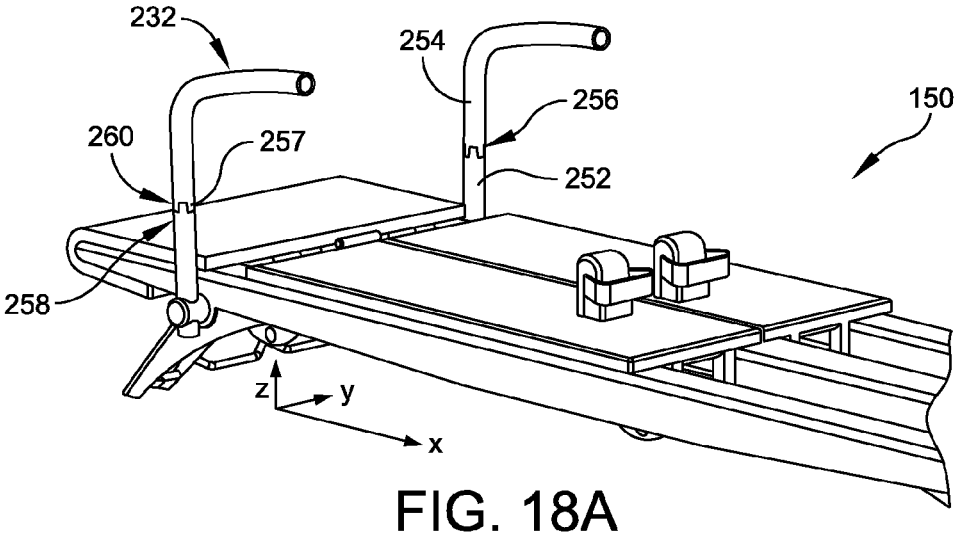
FIGS. 18A-C illustrate perspective views of the reformer of FIGS. 5-6 with a split rest support adjusted to multiple positions about a z-axis.
Figure 18B:
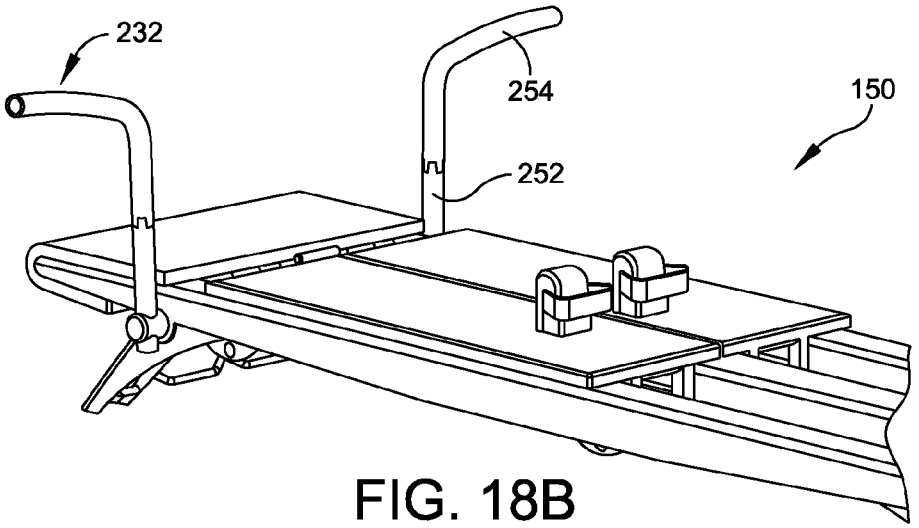
Figure 18C:
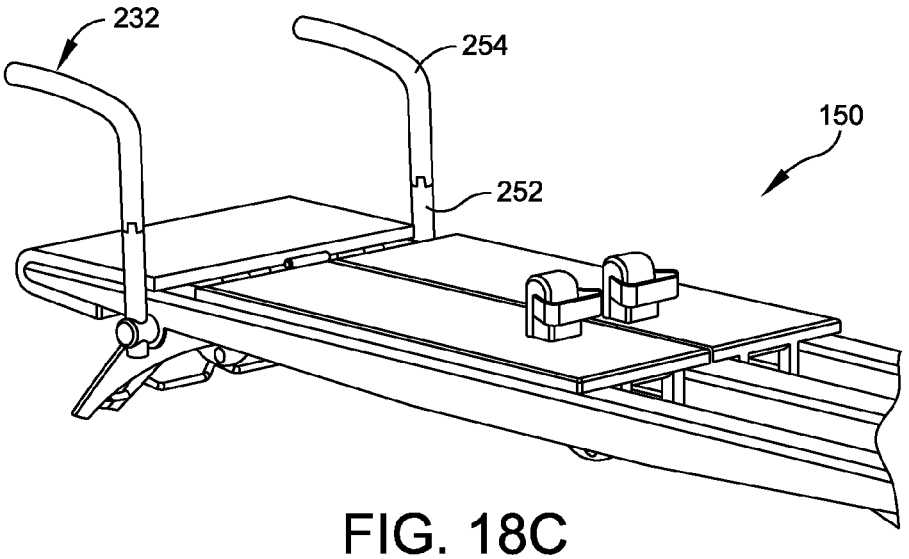

In addition to pivoting about the y-axis, an embodiment of each L-bar 232 may be adjusted to lock at incremental positions over a three-hundred sixty degree rotation about a z-axis, as shown in FIGS. 18A-C. In this embodiment, L-bar 232 may include a lower base portion 252 and an extension portion 254 connected through a lift-and-twist type crenellated joint 256, which is formed by a mating series of crenellated tabs 257 distributed across a top surface 258 of base portion 252 and a bottom surface 260 of extension portion 254. Any desired number of incremental locking positions may be achieved depending on the resolution of crenellated tabs 257.

The ability to rotate each L-bar 232 provides for a host of additional exercises that may be completed upon reformer 150, 151. For example, FIG. 18B shows L-bars 232 rotated by one-hundred-eighty degrees from their starting positions (FIGS. 15-D), allowing for a wider foot or hand stance to work different muscles in the legs or arms. FIG. 18C shows L-bars 232 rotated by ninety degrees from their starting positions. In this configuration, extension portions 254 are parallel and can be used to perform "dips" to exercise a user's tricep muscles.

Although the above embodiments have been described in language that is specific to certain structures, elements, compositions, and methodological steps, it is to be understood that the technology defined in the appended claims is not necessarily limited to the specific structures, elements, compositions and/or steps described. Rather, the specific aspects and steps are described as forms of implementing the claimed technology. Since many embodiments of the technology can be practiced without departing from the spirit and scope of the invention, the invention resides in the claims hereinafter appended.

What is claimed is:

1. An exercise apparatus, comprising:

a frame having first and second ends;

a primary pulley system disposed between said first and second ends of said frame;

a biasing element coupled between said frame and said primary pulley system, said biasing element configured to apply a resistance to said primary pulley system;

a secondary pulley system coupled to said primary pulley system and configured to leverage said resistance applied to said primary pulley system; and a carriage coupled to said secondary pulley system, said carriage having first and second platforms configured to move in unison along an axis of said primary pulley system or in independent directions along an axis of said secondary pulley system.

2. The exercise apparatus of claim 1, wherein said primary pulley system comprises a first pulley disposed at said first end of said frame, a second pulley disposed at said second end of said frame, and a primary cable disposed about said first and second pulleys, wherein said secondary pulley system comprises third and fourth pulleys coupled to said primary cable and a secondary cable disposed about said third and fourth pulleys, and wherein said first platform of said carriage is affixed to a first side of said secondary cable and said second platform of said carriage is affixed to a second side of said secondary cable.

3. The exercise apparatus of claim 2, wherein said third and fourth pulleys indirectly couple to said primary cable through a translating bar having first and second spools in mechanical communication with said third and fourth pulleys, respectively, and wherein said first spool is configured to wind said primary cable when said third pulley rotates in a first direction and release said primary cable when said third pulley rotates in a second direction and said second spool is configured to wind said primary cable when said fourth pulley rotates in said second direction and release said primary cable when said fourth pulley rotates in said first direction.

4. The exercise apparatus of claim 3, wherein said first direction is a clockwise direction and said second direction is a counter-clockwise direction.

5. The exercise apparatus of claim 1, further comprising a latch configured to couple said first and second platforms such that said first platform, said second platform, and said secondary pulley system traverse said axis of said primary pulley system in unison.

6. The exercise apparatus of claim 1, wherein a resistance applied to said secondary pulley system by said primary pulley system substantially equals said resistance applied by said biasing element to said primary pulley system.

7. The exercise apparatus of claim 6, wherein said biasing element comprises one or more tension springs selected based on a strength of said resistance to be applied by said biasing element to said primary pulley system.

8. The exercise apparatus of claim 1, further comprising one or more manual pull ropes strung through each of first and second force-transmittal loops and tethered to each of said first and second platforms, respectively, such that applying force to said manual pull ropes causes displacement in said first and second platforms.

9. The exercise apparatus of claim 1, further comprising at least one split support rest pivotally coupled to said frame.

10. The exercise apparatus of claim 9, wherein said split support rest comprises first and second locking L-bars, each comprising a base portion and an extension portion, wherein each said base portion is configured to pivot independently between a stowed position parallel to said frame and an upright position perpendicular to said frame and each said extension portion is configured to rotate three-hundred-sixty degrees about an axis defined by a centerline of said base portion.

* * * * *